United States Patent [19]

Jalbert

[11] Patent Number: 5,033,734

[45] Date of Patent: Jul. 23, 1991

[54] TRAINING AID FOR SKATERS

[76] Inventor: Timothy J. Jalbert, 38 Upper Reservoir Rd., New Milford, Conn. 06776

[21] Appl. No.: 541,595

[22] Filed: Jun. 21, 1990

[51] Int. Cl.[5] ..... A63C 3/04; A61H 3/00

[52] U.S. Cl. ..... 272/70

[58] Field of Search ..... 272/70, 114, 115; 434/255; 135/67, 74, 75; 280/845, 20, 12.1

[56] References Cited

U.S. PATENT DOCUMENTS

| | | | |
|---|---|---|---|
| 320,462 | 6/1885 | Cowing . | |
| 321,867 | 7/1885 | Van Vleck . | |
| 938,300 | 10/1909 | Coleman | 280/20 |
| 1,141,123 | 6/1915 | Knight . | |
| 1,253,314 | 1/1918 | Warner . | |
| 2,627,904 | 2/1953 | Thieman | 135/67 |
| 2,900,008 | 12/1957 | Seger . | |
| 2,989,114 | 6/1961 | Ecroyd | 272/70 |
| 3,180,652 | 4/1965 | Johansson | 280/20 |
| 3,778,052 | 12/1973 | Andow et al. | 135/67 |
| 3,829,908 | 8/1974 | Thomas | 135/75 |
| 4,005,859 | 2/1977 | Tait | 272/70.3 |
| 4,021,033 | 5/1977 | Auclair . | |
| 4,342,465 | 8/1982 | Stillings | 272/70.3 |
| 4,621,804 | 11/1986 | Mueller | 272/70.3 |
| 4,777,973 | 10/1988 | Nakajima | 272/70 |
| 4,922,860 | 5/1990 | Hutchings | 272/70 |

FOREIGN PATENT DOCUMENTS

| | | | |
|---|---|---|---|
| 579543 | 8/1946 | United Kingdom | 272/70 |

*Primary Examiner*—Richard J. Apley
*Assistant Examiner*—Karen G. Horowitz
*Attorney, Agent, or Firm*—Brumbaugh, Graves, Donohue & Raymond

[57] ABSTRACT

A mobile skating aid for providing support for a beginning skater includes a surrounding main frame supported at approximately waist-height on telescoping posts which extend upwardly from a pair of elongated runners intended to continuously contact a skating surface. The posts are arranged to enable the height of the main frame, which includes a hand rail, to be adjusted, and further to be easily collapsed and folded flat against the underside of the frame for convenient storage and transportation. A seat element flexibly suspended from the main frame at an adjustable distance below the frame at a height to be straddled by the user provides a safety catch which prevents falling even if the skater completely loses footing or traction.

9 Claims, 2 Drawing Sheets

TRAINING AID FOR SKATERS

BACKGROUND OF THE INVENTION

This invention relates to training aids and, more particularly, to a device for use in the instruction of, or individual use by, a beginning skater.

Beginning skaters, both young and old, experience considerable difficulty in mastering the sport, often out of fear of falling and suffering injury. Once a person has taken a bad fall, he or she often times becomes so afraid as to give up trying to learn to skate or, at the least, becomes so cautious that the learning process is slow and lengthy. This is particularly true in the case of older people as they know that a single fall can result in broken bones or other serious injury.

In general, persons learning to skate like the security of holding onto someone, preferably an experienced skater, but even this does not insure against an occasional fall. Also, a good skater may not be available when needed or have the time and patience required to teach the beginner. In any case, since development of self-confidence is an essential ingredient of the learning process, the beginner should not continue to lean on someone for security but, instead, go it alone as soon as possible.

While the need for training and safety devices for beginning skaters has long been recognized (see, for example, U.S. Pat. Nos. 320,462 and 321,867, issued in 1915) and a number of other skating aids have been proposed more recently (U.S. Pat. Nos. 2,900,008 (1959) and 4,021,033 (1977)), those devices have the disadvantages that they tend to restrict and confine the user in a manner which limits the ability to skate in the natural skating position. Also, all of these known devices have an upper hand rail to be grasped by the skater which, in the case of the structure shown in U.S. Pat. No. 4,021,033 is open at the rear, as security against falling. However, should the skater be distracted and release the grip on the hand rail, he/she may still fall onto the ice or other skating surface. It is particularly desirable that the device include means for catching the skater, in the event of a fall, before he/she hits the ice but which does not interfere with natural skating action.

Other features that a training device of this kind should possess include: simple and low cost construction; foldable or collapsible into a flat, compact configuration to facilitate its transport and storage; and easy height adjustment so that it may be used by skaters of various ages and sizes.

It is among the objects of the present invention to provide an improved mobile skating aid which builds the beg1nner's confidence by providing support without unduly interfering with his/her freedom of movement.

Another object of the invention is to provide an improved skating aid of the type described which is of light weight, inexpensive and simple construction and which is easily adjustable for use by skaters of different ages and sizes.

A further object is to provide an improved skating aid of the type described which includes a seat for interrupting a fall and preventing the user from striking the skating surface.

SUMMARY OF THE INVENTION

Briefly, the skating aid according to the invention is constructed of hollow tubing and includes a closed upper frame having rounded corners, and two generally U-shaped frames secured to and, in use, depending substantially vertically from the upper frame to form a pair of runners to enable the device to move freely over the skating surface. Preferably, each side frame consists of two tubular posts, one secured at each end of a side rail of the upper frame, the lower ends of which are supported for telescopic adjustment in respective upturned ends of a tubular runner member for quick and easy adjustment of the height of the upper frame. A body-supporting element, flexibly attached to the upper frame, is structured to provide support in the event the skater loses control and starts to fall, yet does not interfere with a natural skating motion.

Other objects, features and advantages of the invention will become apparent, and a better understanding of its construction and operation will be had, from the following detailed description read in conjunction with the accompanying drawings.

DESCRIPTION OF THE PREFERRED EMBODIMENT

Figure 1:
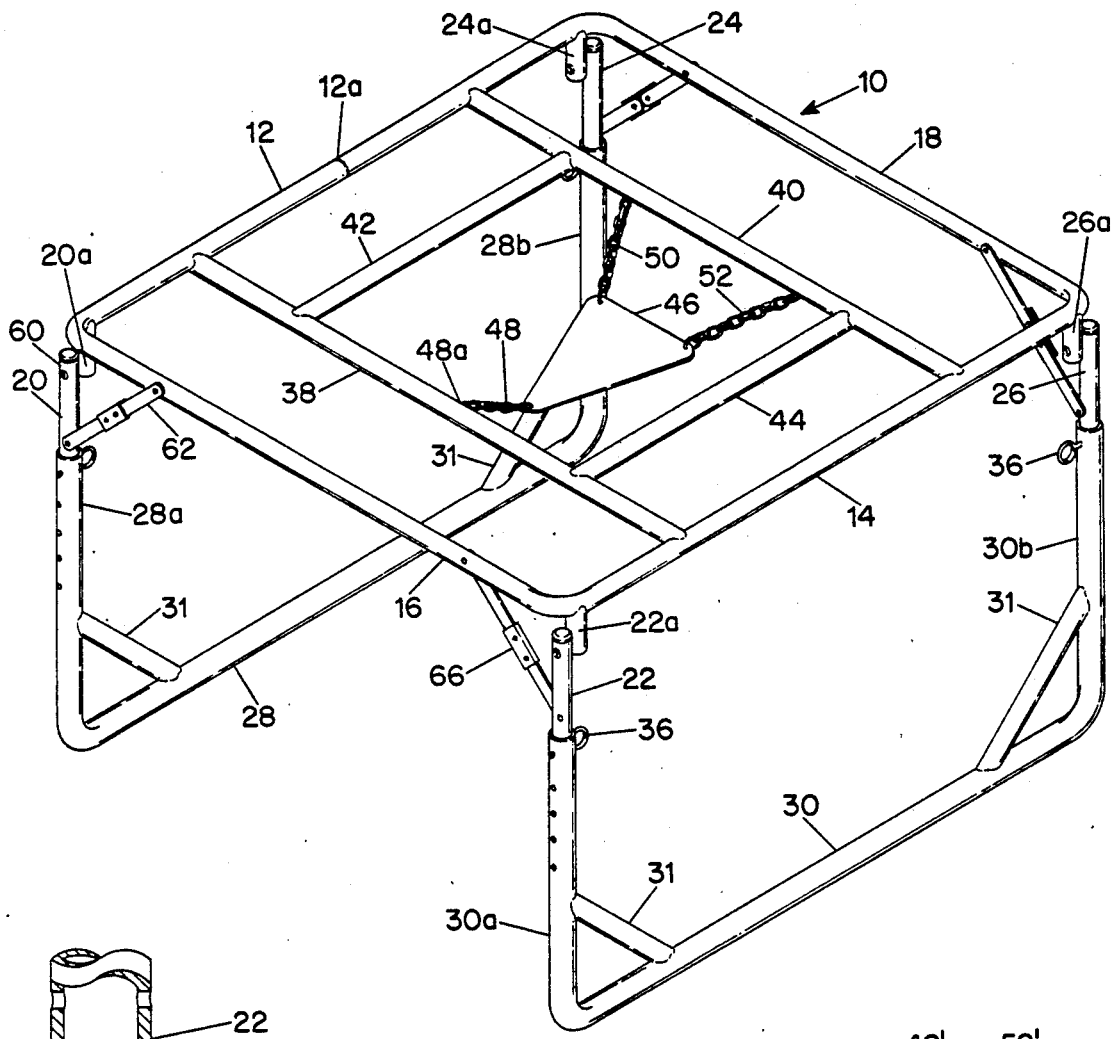
FIG. 1 is a perspective view of a skating aid constructed in accordance with the invention.
Figure 2:
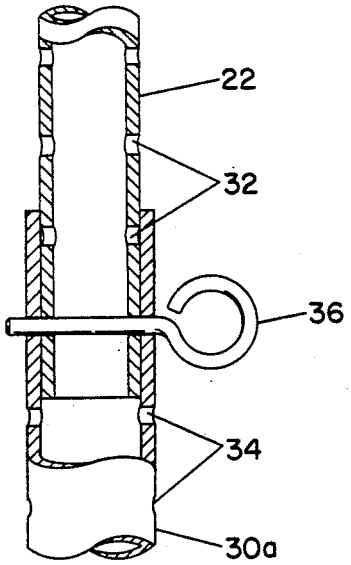
FIG. 2 is an enlarged detail view showing the telescopic adjustment of the posts of the device.

As shown in the drawings, the skating aid of the invention includes an upper main frame 10, preferably rectangularly shaped and having opposite side members 12 and 14 and front end and back end members 16 and 18, respectively. Frame 10 is preferably formed of a continuous length of hollow, lightweight metal tubing, such as aluminum, bent so as to form rounded corners and with its ends suitably joined together at **12*a*, for example, as by welding. The main frame 10 is supported at an adjustable height above the skating surface by a pair of front support posts 20 and 22 and a pair of back support posts 24 and 26. These posts are tubular and are joined at their upper ends to frame 10 at respective corners thereof in a manner to be described presently. The lower ends of front posts 20 and 22 are telescopically received in the upwardly facing openings of the upturned front ends 28*a* and 30*a*, respectively, of a pair of tubular runners 28 and 30, and the lower ends of posts 24 and 26 are respectively received in the upturned ends 28*b* and 30*b* of the runners. Each of the upturned ends is braced for greater strength and rigidity by a section of tubing 31 disposed at an angle between and welded at its ends to the upturned end and to the top side of the runner. The tubular runners enable the device to slide on ice with little frictional resistance. The posts and the runners may be selectively interlocked at a desired position by means of aligned openings 32 and 34 in the posts and runners, respectively, and locking pins 36 as shown in detail in FIG. 2. The plurality of holes in the two sections 22 and 30*a* (and similarly in the other three mating sections) allow the effective length of the post 22 to be varied to thereby vary the height of frame 10**, while maintaining its horizontal aspect, so that the skating aid may accommodate users of different heights.

A front hand rail 38, also formed of tubular metal, extends transversely between and is secured at its ends to side members 12 and 14 of the main frame, as by welding, and is disposed in spaced parallel relationship with front end member 16; a transverse tubular back rail 40 is similarly spaced inwardly from back end member 18. The main frame assembly is completed by a pair of tubular bars 42 and 44, both extending between hand rail 38 and back rail 40 and disposed parallel to each other and to side members 12 and 14 of frame 10, which together define a generally square enclosure, preferably adjusted to approximately waist-height, which surrounds the skater.

A body-supporting element 46 in the form of a triangularly-shaped seat formed of a lightweight and flexible, yet strong, sheet material, such as leather, vinyl, or nylon is supported on main frame 10 by three flexible support members 48, 50 and 52, preferably in the form of a flexible chain, having relative lengths such as to position the seat element below the plane of the main frame, on the long axis of the skating aid, closer to back rail 40 than to hand rail 38, and to be tilted downwardly and forwardly. More particularly, chain 48 is secured at one end to a forwardly directed apex of seat member 46 and at the other end is detachably secured, via a length adjusting device **48*a* to the midpoint of hand rail 38, and chains 50 and 52 are secured at spaced apart points on back rail 40. Chains 50 and 52, the length of both of which is also adjustable, are shorter than chain 48** by an amount to position the seat closer to the back than the front of the enclosure and to cause the seat to tilt forwardly.

Figure 4:
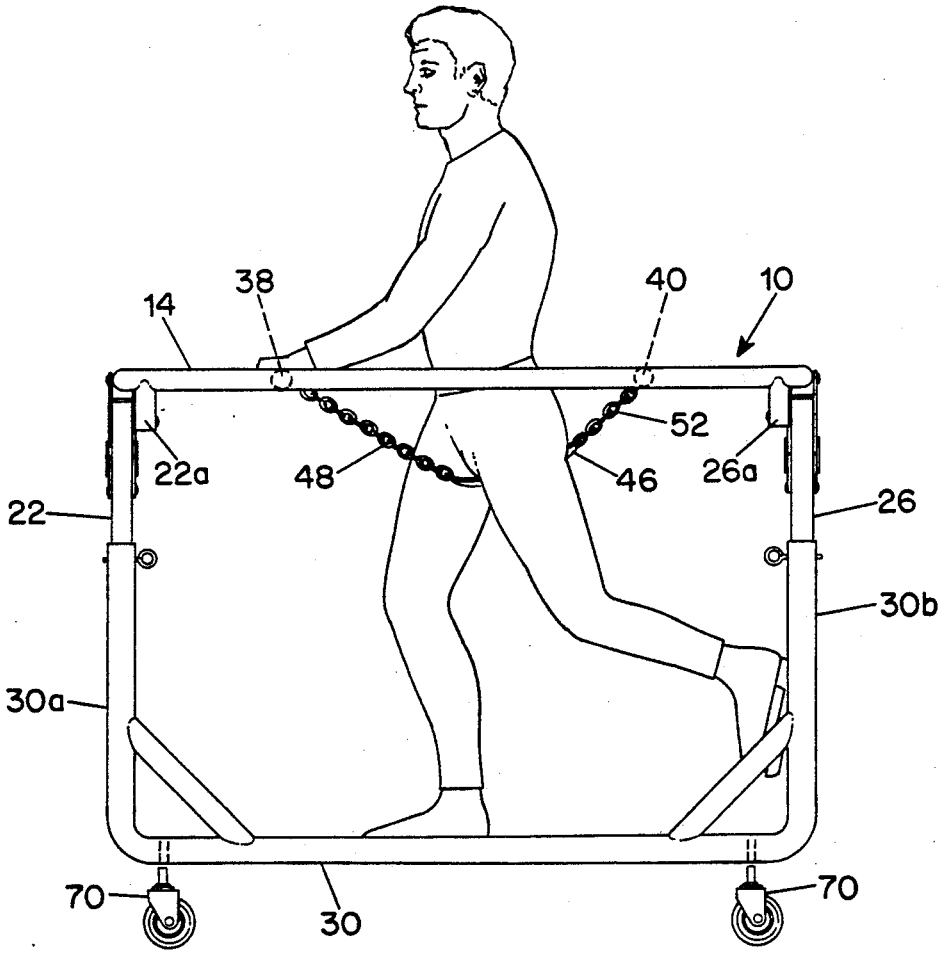
FIG. 4 is a side view of the skating aid in use.

Preparatory to using the skating aid the front chain 48 is unhooked from the hand rail to permit the user to slide under the unit and to get into skating position, chain 48 is hooked to the hand rail, and the main frame 10 is adjusted to about the waist height of the intended user and, as pictorially depicted in FIG. 4, the chains 48, 50 and 52 are adjusted to have lengths such that when the user stands in an upright position astride chain 48, approximately in the position in which he or she will be skating, the seat element hangs freely between the user's legs, a few inches below the buttocks. It is not intended that the seat element support the user in any way while skating because this would defeat the purpose of the training aid; rather, the seat element and the chains on which it is suspended are sufficiently flexible as to hardly be noticed by the user, much less interfere with normal skating motion. Only in the event the beginner loses control and starts to fall is he/she supported by the seat element and then only for the short time required to again stand up. However, after a period of strenuous skating, the seat element provides a convenient resting place.

While chains have been described as preferred members for supporting the seat element, other means such as straps made of leather or nylon, or sections of a suitably flexible rope may be used.

Figure 3:
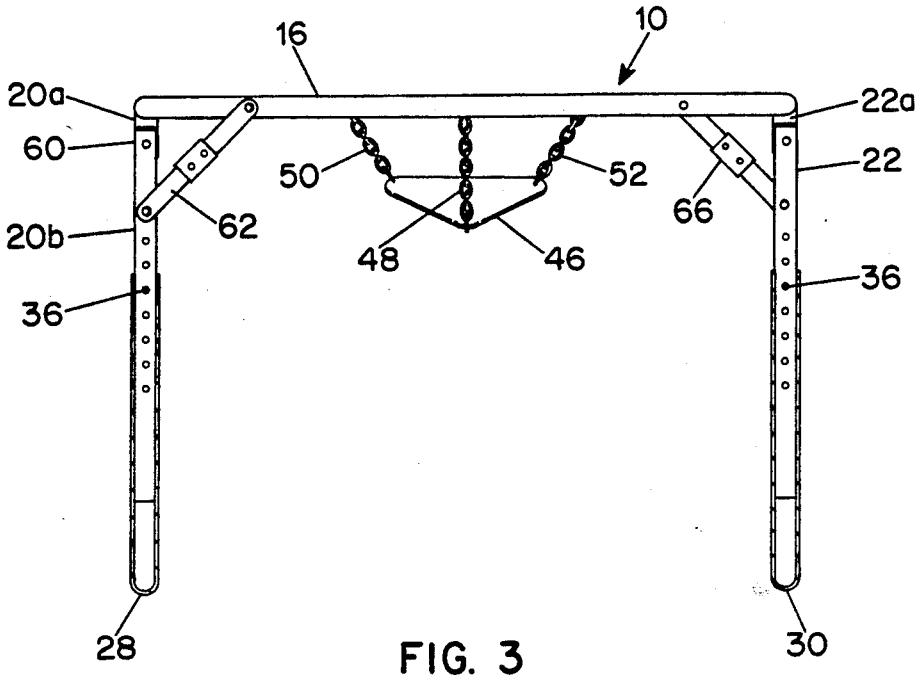
FIG. 3 is a front end view of the device.

As best seen in FIG. 3, each of the posts consists of a short upper tubular section **20*a*, 22*a*, 24*a*, and 26*a* all of the same length, secured at its upper end, as by welding, to the underside of frame 10 and closed at the lower end with a plastic cap or plug, and a longer lower section 20, 22, 24 and 26, respectively, also of equal length, and closed at its upper end with a plastic cap or plug for neatness. Each of the lower sections are hingedly connected to a respective upper section by a pivot pin 60 disposed parallel to the runners and extending through both tubular sections; however, the pivot pins extending through lower sections 22 and 26 are positioned lower than the pivot pins which extend through lower sections 20 and 24** to facilitate folding of the device.

Post 20, **20*a* is releasably locked in a vertical position by a collapsible leg bracket 62 pivotally secured at its ends to the outer faces of leg 20 and frame 10, and post 24, which depends from the rear corner on the same side of the frame is similarly constructed and braced. Posts 22 and 26 are releasably locked in their operating positions by a collapsible bracket, one of which is visible at 66 in FIG. 3, pivotally secured at its ends to the inside surfaces of leg 22 and frame 10. The device is easily collapsed for transport and storage by first unlocking the leg brackets which brace posts 20 and 24 and folding them and the associated runner 28 against the under surface of main frame 10, and then unlocking the leg brackets which brace legs 22 and 26 and folding them and the associated runner 30 over the already folded legs 20, 24**. The result is a flat package which can be easily stowed in the trunk or back seat of an automobile for transport and requires relatively little storage space.

For protection from the cold metal tubing, at least the central portion of hand rail 38, and preferably also at least the central portion of back rail 40, are covered with thermal insulation, which may take the form of a thin-walled sleeve of foamed plastic or rubber.

It will now be evident that the seat element in conjunction with the surrounding main frame provides a safety catch which prevents the skater from falling, despite even complete loss of footing or traction. Also important to the beginning skater, the seat element can be used to support the body while resting the legs to prevent excess fatigue of the legs and ankles. The full length runners 28 and 30 provide continuous contact with the skating surface and insure stability of the device even under uneven surface conditions, and because there are no abrupt edges the device is safe to the user as well as to other skaters.

The system is easily adjustable to optimally accommodate skaters of a variety of sizes and ages. The telescoping posts may be adjusted without the use of tools simply by pulling the quick release pins and sliding the posts to select the desired frame height, and the seat position likewise is readily adjustable.

Figure 5:
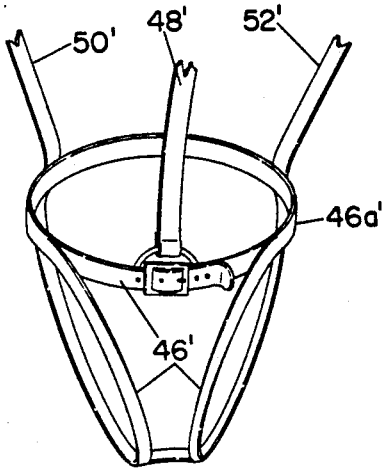
FIG. 5 is a perspective view of an alternative seat construction for use by handicapped persons.

The described training aid is also ideal for helping physically handicapped persons to safely participate in skating activities and perhaps to learn how to skate unattended. To help the handicapped person maintain balance and coordination the triangularly-shaped seat element 46 is replaced with the harness structure 46' shown in FIG. 5 consisting of a waist-encircling belt **46*a*' having leg straps depending therefrom and which is suspended from the upper frame by three flexible straps 48', 50' and 52' of adjustable length. Strap 48' preferably includes means (not shown) for detachably securing its free end to hand rail 38** to facilitate entry of the user. With the harness in place on a standing user, the straps are adjusted to have lengths so as to be slack and not support the user while skating but to be available in the event of loss of control.

While a preferred embodiment of the invention has been illustrated and described, it will be evident that various changes and modifications may be effected without departing from the spirit and scope of the invention. For example, the aid may be adapted for use on the street or on an indoor roller skating rink by inserting the stem of each of four casters 70 of conventional construction, two of which are visible in FIG. 4, into a respective socket provided in the under surface of the runners 28 and 30 near the ends thereof. The device may be made from any lightweight tubular metal that will give the device the necessary strength and rigidity to withstand the normal weight and forces to which it may be subjected.

I claim:

1. A skating training aid oomprising:

an upper frame having opposite side edges and opposite front and back edges and portioned to be approximately waist height, a pair of parallel runners having a length substantially equal to the length of said frame and spaced from each other by substantially the spacing of said side edges, means for supporting said frame substantially horizontally at a selectively adjustable height above said runners, including a telescoping post extending upwardly and substantially vertically from each end of each runner and secured to said frame at a respective corner, wherein a portion of said post is formed from upturned ends of each end of each of said runners, and means including a body-supporting element suspended from and disposed in a position below said frame to be straddled by a skater standing within and surrounded by said frame and facing the front edge thereof for catching the skater in the event of a fall.

2. A skating training aid as defined in claim 1, wherein said runners are tubular and both ends of both runners are bent upwardly for forming a first telescoping section of a respective post consisting of two telescoping sections, the second of which is secured to said upper frame, a plurality of openings formed in said sections spaced to be selectively aligned with one another for individually varying the length of said posts, and a pin cooperating with said openings for releasably securing the two sections together at a selected length.

3. A skating training aid as defined in claim 2, wherein the second section of each post includes hinge means arranged to permit each runner and its associated posts to be folded flat against the underside of said upper frame.

4. A skating training aid as defined in claim 1, wherein said body-supporting element is a triangularly shaped sheet of flexible material suspended from said upper frame on three flexible supporting members each secured at one end to an apex of the sheet, and wherein a first of said supporting numbers extends toward the front end of said frame and the other two supporting members extend toward the back end of the frame.

5. A skating training aid as defined in claim 1, wherein said upper frame includes substantially parallel hand and back rails extending transversely between and secured to said side edges and spaced from said front and back edges, respectively, and wherein said body-supporting element is a triangularly-shaped sheet of flexible material suspended on three flexible supporting members each secured at an apex of the sheet, a first of which is detachably secured to said hand rail with the other two secured at spaced locations on said back rail.

6. A skating training aid as defined in claim 4 or claim 5, wherein each flexible supporting member includes means for adjusting its length.

7. A skating training aid as defined in claim 1, wherein said body-supporting element comprises a harness including a body-encircling belt suspended from said upper frame on three flexible supporting members secured at one end to said belt at spaced apart locations, a first of which extends toward the front end of said frame and the other two extend toward the back end of said frame.

8. A skating training aid as defined in claim 1, wherein said upper frame includes subtantially parallel hand and back rails extending transversely between and secured to said side edges, and wherein said body-supporting element comprises a harness including a waist-encircling belt and leg straps secured thereto, said harness being suspended on three flexible supporting members each secured at one end to said belt, one of which is detachably secured to said hand rail and the other two are secured at spaced locations on said back rail.

9. A skating training aid comprising:

a pair of runners each comprising an elongate tubular member bent up at both ends for forming a first vertically oriented section of a telescoping post consisting of two sections, a generally rectangular upper frame having side edges of a length substantially equal to the distance between the post sections of said runners, front and back edges, and transverse hand and back rails spaced inwardly from said front and back edges, respectively, a second post section telecopically received in and extending upwardly from each first post section and secured to a respective corner of said frame for supporting said frame substantially horizontally, and means including a plurality of openings in said first and second sections and a pin cooperating with said openings for releasably securing the two sections together at a desired adjusted height above said runners, each second post section including hinge means arranged for permitting each runner and its associated posts to be folded flat against the underside of said frame, and a triangularly-shaped seat element formed of flexible sheet material suspended from and disposed in a position below said frame substantially equidistant from its side edges on three flexible supporting members of adjustable length each secured at one end to a respective apex of the seat element, a first of which is detachably secured to said hand rail at a location substantially equidistant from its ends with the other two secured at spaced locations on said back rail to orient said first support member substantially parallel to said side edges so that it can be straddled by a skater standing between said back and hand rails and facing the front edge of the frame for catching a skater in the event of a fall.

* * * * *

UNITED STATES PATENT AND TRADEMARK OFFICE

CERTIFICATE OF CORRECTION

PATENT NO. : 5,033,734

DATED : July 23, 1991

INVENTOR(S) : Timothy J. Jalbert

It is certified that error appears in the above-identified patent and that said Letters Patent is hereby corrected as shown below:

Col. 5, line 12, "portioned" should read --positioned--.

Signed and Sealed this

Twenty-second Day of December, 1992

*Attest:*

DOUGLAS B. COMER

*Attesting Officer*

*Acting Commissioner of Patents and Trademarks*